US007725313B2

(12) United States Patent
Konda et al.

(10) Patent No.: US 7,725,313 B2
(45) Date of Patent: May 25, 2010

(54) METHOD, SYSTEM AND APPARATUS FOR ALLOCATING BITS IN PERCEPTUAL AUDIO CODERS

(75) Inventors: Preethi Konda, Bangalore (IN); Vinod Prakash, Bangalore (IN)

(73) Assignee: Ittiam Systems (P) Ltd., Bangalore, Karnataka (IN)

( * ) Notice: Subject to any disclaimer, the term of this patent is extended or adjusted under 35 U.S.C. 154(b) by 1355 days.

(21) Appl. No.: 10/939,533

(22) Filed: Sep. 13, 2004

(65) Prior Publication Data

US 2006/0069555 A1 Mar. 30, 2006

(51) Int. Cl.
*G10L 19/00* (2006.01)
*G10L 21/00* (2006.01)

(52) U.S. Cl. ..... 704/229; 704/230; 704/500; 704/500.1; 704/200; 704/200.1

(58) Field of Classification Search ..... 704/229, 704/230, 500, 500.1, 200, 200.1
See application file for complete search history.

(56) References Cited

U.S. PATENT DOCUMENTS 5,864,802 A * 1/1999 Kim et al. ..... 704/230
5,956,674 A * 9/1999 Smyth et al. ..... 704/200.1
6,098,039 A * 8/2000 Nishida ..... 704/229
6,104,996 A * 8/2000 Yin ..... 704/500
6,134,523 A * 10/2000 Nakajima et al. ..... 704/229
6,246,345 B1 * 6/2001 Davidson et al. ..... 341/51
6,370,499 B1 * 4/2002 Fujii ..... 704/200.1
6,487,535 B1 * 11/2002 Smyth et al. ..... 704/500
6,792,402 B1 * 9/2004 Chen ..... 704/200.1
2001/0053973 A1 * 12/2001 Tsuzuki ..... 704/229
2002/0004718 A1 * 1/2002 Hasegawa et al. ..... 704/229
2004/0098268 A1 * 5/2004 Ha ..... 704/500

* cited by examiner

*Primary Examiner*—David R Hudspeth
*Assistant Examiner*—Abdelali Serrou
(74) *Attorney, Agent, or Firm*—Prakash Nama; Global IP Services, PLLC

(57) ABSTRACT

A non-iterative and computationally efficient bit allocation technique for perceptual audio coders employing uniform quantization schemes. This is achieved by computing a target MNR for all critical bands in a frame using a target bit rate and associated SMRs. Associated SNRs are then computed for the critical bands using the computed target MNR and the associated SMRs. Bits are then allocated to the critical bands based on the computed associated SNRs.

10 Claims, 3 Drawing Sheets

METHOD, SYSTEM AND APPARATUS FOR ALLOCATING BITS IN PERCEPTUAL AUDIO CODERS

FIELD OF THE INVENTION

This invention relates to the field of perceptual audio coding (PAC), and more specifically to a method, system and apparatus to a bit allocation technique.

BACKGROUND OF THE INVENTION

In the present state of the art audio coders for use in coding signals representative of, for example, speech and music, for purposes of storage or transmission, perceptual models based on the characteristics of the human auditory system are typically employed to reduce the number of bits required to code a given signal. In particular, by taking such characteristics into account, "transparent" coding (i.e., coding having no perceptible loss of quality) can be achieved with significantly fewer bits than would otherwise be necessary. The coding process in perceptual audio coders is compute intensive and generally requires processors with high computation power to perform real-time coding. The quantization module of the encoder takes up a significant part of the encoding time.

In such coders, the signal to be coded is first partitioned into individual frames with each frame comprising a small time slice of the signal, such as, for example, a time slice of approximately twenty milliseconds. Then, the signal for the given frame is transformed into the frequency domain, typically with use of a filter bank. The resulting spectral lines may then be quantized and coded.

In particular, the quantizer which is used in a perceptual audio coder to quantize the spectral coefficients is advantageously controlled by a psychoacoustic model (i.e., a model based on the characteristics of the human auditory system) to determine masking thresholds (distortionless thresholds) for groups of neighboring spectral lines referred to as one critical factor band. The psychoacoustic model gives a set of thresholds that indicate the levels of Just Noticeable Distortion (JND); if the quantization noise introduced by the coder is above this level then it is audible. As long as the Signal-to-Noise Ratio (SNR) of the critical bands is higher than the Signal-to-Mask Ratio (SMR), the quantization noise cannot be perceived. The quantizer utilizes the SMRs to control bit allocation for the critical bands. The quantizer operates in such a way that, the difference between the SNR and the SMRs, which is the mask-to-noise ratio (MNR), is constant for all critical bands in the frame. Maintaining equal or near equal MNRs for all the critical bands ensures peak audio quality as the critical bands are equally distorted in a perceptual sense.

In MPEG (Moving Picture Experts Group) Audio coders a major portion of the processing time is spent in the quantization module as the process is carried out iteratively. The MPEG-I/II Layer 1 and Layer 2 encoders use uniform quantization schemes. The Quantizer uses different values of step sizes for different critical bands depending on the distortion thresholds set by a psychoacoustic block.

In one conventional method employing the uniform quantization schemes, quantization is carried out in an iterative fashion to satisfy perceptual and bit rate criteria. The iterative procedure includes determining the band with the lowest MNR and increasing the precision of the band using the next highest number of bits. The SNR of the band increases typically by about 6 db in this process, as the quantizer is uniform in nature. This is followed by calculating the new MNR of that band and updating the number of bits consumed during this process. The above procedure is repeated until the bit rate criterion is met.

Irrespective of the target bit rate, the conventional method begins encoding by assigning a lowest possible quantization step size to the critical bands. Thus, the complexity of the conventional method increases as the bit rate increases. Therefore, the conventional methods are highly computation intensive and can take up significant part of an encoder's time.

SUMMARY OF THE INVENTION

According to a first aspect of the invention there is provided a method of coding an audio signal based on perceptual model employing uniform quantization schemes, the method comprising the steps of:

a) computing a target MNR for all critical bands in a frame using a target bit rate and associated SMRs;
b) computing associated SNRs for the critical bands in the frame using the target MNR and the associated SMRs; and
c) allocating bits to the critical bands based on the associated SNRs.

Preferably the audio signal is partitioned into a sequence of frames. Preferably spectral lines in each frame are grouped to form a plurality of critical bands. Preferably the critical bands in the frame are sorted in a descending order of associated SMRs to form a sorted critical band array. Preferably a binary search is performed on the sorted critical band array to find a target MNR and SNRs that are independent of the target bit rate to reduce the computational complexity.

According to a second aspect of the invention, there is provided an article including a storage medium having instructions that, when executed by a computing platform, result in execution of a method for coding an audio signal based on perceptual model, the method comprising the steps of:

a) computing a target MNR for all critical bands in a frame using a target bit rate and associated SMRs;
b) computing associated SNRs for the critical bands in the frame using the target MNR and the associated SMRs; and
c) allocating bits to the critical bands based on the associated SNRs.

According to a third aspect of the invention there is provided an apparatus for encoding an audio signal based on perceptual model, the apparatus comprising:

a) an encoder that computes a target MNR for all critical bands in a frame using a target bit rate and associated SMRs, and wherein the encoder computes SNRs for all critical bands using the target MNR; and
b) a bit allocator that allocates bits to all critical bands based on the associated SNRs.

According to a fourth aspect of the invention there is provided a system for encoding an audio signal based on perceptual model, the apparatus comprising:

a) a bus;
b) a processor coupled to the bus;
c) a memory coupled to the processor;
d) a network interface coupled to the processor and the memory; and
e) an audio coder coupled to the network interface and the processor, wherein the audio coder further comprises:
f) an encoder that computes a target MNR for all critical bands in a frame using a target bit rate and associated SMRs, and wherein the encoder computes SNRs for all critical bands using the target MNR; and g) a bit allocator that allocates bits to all critical bands based on the associated SNRs.

DESCRIPTION OF PREFERRED EMBODIMENTS

In the following detailed description of the preferred embodiments, reference is made to the accompanying drawings that form a part hereof, and in which are shown by way of illustration specific embodiments in which the invention may be practiced. It is understood that other embodiments may be utilized and structural changes may be made without departing from the scope of the present invention.

The leading digit(s) of reference numbers appearing in the Figures generally corresponds to the Figure number in which that component is first introduced, such that the same reference number is used throughout to refer to an identical component which appears in multiple Figures. The same reference number or label may refer to signals and connections, and the actual meaning will be clear from its use in the context of the description.

Terminology

The term "coder" and "encoder" are used interchangeably throughout the document.

Figure 1:
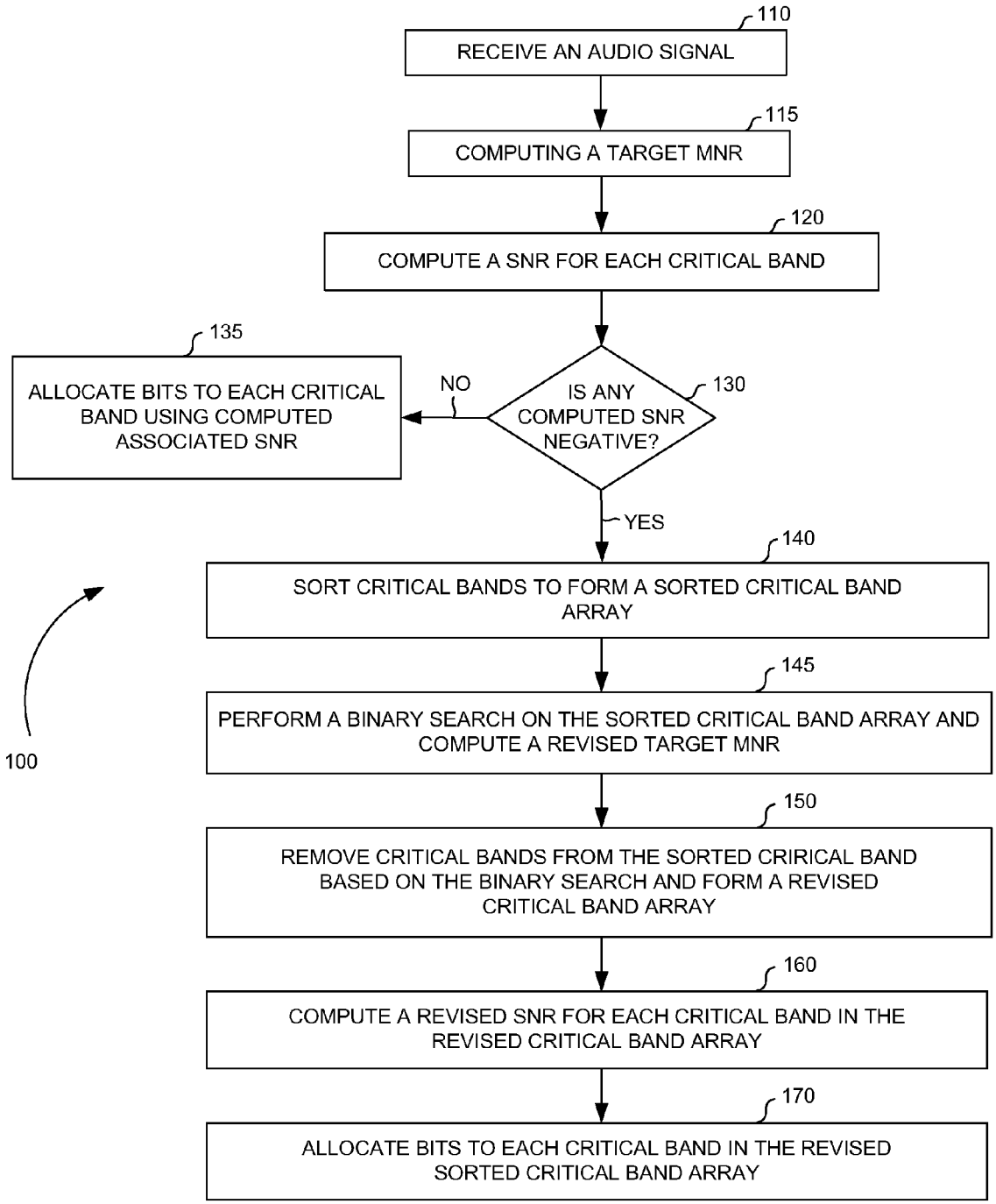
FIG. 1 is a flowchart illustrating an example method of bit allocation in perceptual audio coders according to an embodiment of the present invention.

Referring now to FIG. 1, there is illustrated a method 100 of encoding an audio signal based on a perceptual model. At 110, the method 100 receives an audio signal and then partitions the received audio signal into a sequence of successive frames. Spectral lines in each frame are then grouped to form a plurality of critical bands. Each of the critiacal bands in a frame is associated with an SMR provided by a psychoacoustic model.

At 115, a target MNR is computed for each of the critical bands in a frame using a target bit rate and associated SMRs. In one embodiment, the target MNR is computed using the equation:

$$\text{target } MNR = \left(6TB - \sum_{NB} SMR_b l_b\right) \Big/ N$$

wherein TB is the Target bit rate, $SMR_b$ is the SMR of critical band b, N is the number of frequency lines in the frame, NB is the number of critical bands in the frame, and $1_b$ is the number of frequency lines in critical band b.

Generally, all bit allocation algorithms in perceptual coders aim to maintain a constant MNR across all critical bands in a given frame. Maintaining equal or near equal MNRs for all the critical bands ensures peak audio quality as the critical bands are equally distorted in a perceptual sense. Based on this presumption, a target MNR is computed for a given frame and a specified target bit rate.

At 120, associated SNRs for the critical bands in the frame are computed using the computed target MNR and given associated SMRs. In some embodiments, the associated SNR for each critical band in the frame is computed using the following equation:

$$SNR_b = \text{target MNR} + SMR_b$$

wherein $SNR_b$ is the signal-to-noise ratio of critical band b, MNR is the target MNR, and $SMR_b$ is the signal-to-mask ratio for the critical band b.

However, one or more of the computed SNRs can be negative. This condition is more likely to occur when the target bit rate is too low. A negative SNR may be mathematically correct, but is impractical, meaning that this critical band gives away bits to other critical bands. The implication of any of the negative ratios in the critical bands is that not all critical bands can be allotted bits. Therefore, this boundary condition needs to be corrected before proceeding with the bit allocation to each of the critical bands in the frame.

In some embodiments, this condition is corrected by excluding the critical band associated with the most negative SNR in the computation of the target MNR and re-computing the SNRs. This process is repeated until all SNRs associated with all the critical bands are non-negative. The following describes one example embodiment of the implementation of the technique used in arriving at the non-negative SNRs to allocated bits to the critical bands.

At 130, the computed SNRs are checked to see if there are any negative SNRs in the computed SNRs. If there are no negative SNRs in the computed SNRs, then the method 100 goes to act 135 and allocates bits to each critical band using the computed associated SNRs. In some embodiments, the bits are allocated to the critical bands using the equation, $$B_b = 1_b SNR_b / 6$$

wherein $B_b$ is the bits consumed by critical band indexed by b, $1_b$ is the length of the critical band b, and $SNR_b$ is the SNR of the critical band b.

If one or more of the computed SNRs are negative, then the method 100 goes to act 140. At 140, the critical bands are sorted to form a sorted critical band array. In one embodiment, the critical bands are sorted in a descending order of their SMRs. The following example illustrates the computation of the target MNR, computation of the SNRs for each of the critical bands in the frame, the checking of the computed SNRs for any negative ratios, and the formation of the sorted critical band array.

The table below illustrates an example frame having 10 critical bands, (i.e., NB=10), $1_b$=10, N=NB*$1_b$ with their associated SMRs

| Critical band Number | SMR |
|---|---|
| 1 | 3 |
| 2 | 8 |
| 3 | 6 |
| 4 | 5 |
| 5 | 11 |
| 6 | 8 |
| 7 | 15 |
| 8 | 4 |
| 9 | 8 |
| 10 | 9 |

Using the above equation and a target bit rate, TB=30, the target MNR is computed as follows:

$$\text{target MNR} = (6*10 - \Sigma SMR_b 1_b)/N = (6*10 - 770)/100) = -5.9$$

Using a computed target MNR of −5.9, the SNRs of the critical bands are computed using the above equation and the computed SNRs are as shown in the table below:

| Critical band Number | SNR |
|---|---|
| 1 | −2.9 |
| 2 | 2.1 |
| 3 | 0.1 |
| 4 | −0.9 |
| 5 | 5.1 |
| 6 | 2.1 |
| 7 | 9.1 |
| 8 | −1.9 |
| 9 | 2.1 |
| 10 | 3.1 |

It can be seen from the above table that critical bands 1, 4, and 8 have negative ratios. In one embodiment, the critical band 1, which has the lowest SNR, is eliminated and the above outlined procedure is repeated until all of the computed SNRs are non-negative. However, using this approach can be computationally intensive.

In another embodiments, a binary search is performed by sorting the above critical band array in a descending order of the SMRs. The table below illustrates the above critical band array sorted in the descending order along with a field including associated cumulative sum of $\Sigma SMR_b 1_b$:

| Critical Band Number | SMR | Cumulative sum ($SMR_b l_b$) |
|---|---|---|
| 7 | 15 | 150 |
| 5 | 11 | 260 |
| 10 | 9 | 350 |
| 2 | 8 | 430 |
| 6 | 8 | 510 |
| 9 | 8 | 590 |
| 3 | 7 | 650 |
| 4 | 5 | 700 |
| 8 | 4 | 740 |
| 1 | 3 | 770 |

At 145, a binary search is performed on the sorted critical band array. In these embodiments, the binary search is performed on the sorted critical band array to find a critical band boundary such that the SNR of a critical band at the critical band boundary is positive and including another critical band to the right of the critical band boundary for bit allocation results in a negative SNR for the critical band at the boundary.

In our above running example, a binary search is performed on the critical bands as follows:

In the first step of the binary search a target MNR is calculated using the top half of the critical bands in the above sorted critical band array, which are the 5 critical bands 7, 5, 10, 2, and 6. The target MNR for these 5 critical bands turns out to be −6.6. Using this target MNR in the critical band 6 results in an SNR of (−6.6+8)=1.4, which is positive. Therefore, the binary search is done on the critical bands using the lower half of the critical band sorted array, i.e., using critical bands 9, 3, 4, 8, and 1. The binary search stops at critical band number 9, i.e., at NB=6, which is the critical band boundary.

At the end of the binary search, the final target MNR is computed as follows:

Final target MNR=[(6*30−590)/6]=−6.83.

At 150, the critical bands that fall to the right of the determined critical band boundary are removed from the sorted critical band array to form a revised sorted critical band array.

Therefore, in our running example, the critical bands 3, 4, 8, and 1 are excluded from the calculation and a revised sorted critical band array is formed by removing critical bands 3, 4, 8, and 1 as follows:

| Critical Band Number | SMR | Cumulative sum ($SMR_b l_b$) |
|---|---|---|
| 7 | 15 | 150 |
| 5 | 11 | 260 |
| 10 | 9 | 350 |
| 2 | 8 | 430 |
| 6 | 8 | 510 |
| 9 | 8 | 590 |

At 160, revised SNRs are computed for the critical bands in the revised sorted critical band array. At 170, bits are allocated to all the critical bands in the revised sorted critical band array. No bits are allocated to the critical bands that were eliminated using the binary search process.

In our running example, the computed SNRs and the allocated bits to the critical bands after performing the binary search are as illustrated in the table below.

| Band Number | SMR | SNR | Bits Allocated |
|---|---|---|---|
| 7 | 15 | 8.166666667 | 13 |
| 5 | 11 | 4.166666667 | 7 |
| 10 | 9 | 2.166666667 | 3 |
| 2 | 8 | 1.166666667 | 2 |
| 6 | 8 | 1.166666667 | 2 |
| 9 | 8 | 1.166666667 | 2 |
| 3 | 6 | 0 | 0 |
| 4 | 5 | 0 | 0 |
| 8 | 4 | 0 | 0 |
| 1 | 3 | 0 | 0 |

Although the flowchart 100 includes steps 110-170 that are arranged serially in the exemplary embodiments, other embodiments of the subject matter may execute two or more steps in parallel, using multiple processors or a single processor organized as two or more virtual machines or sub-processors. Moreover, still other embodiments may implement the steps as two or more specific interconnected hardware modules with related control and data signals communicated between and through the modules, or as portions of an application-specific integrated circuit. Thus, the exemplary process flow diagrams are applicable to software, firmware, and/or hardware implementations.

Figure 2:
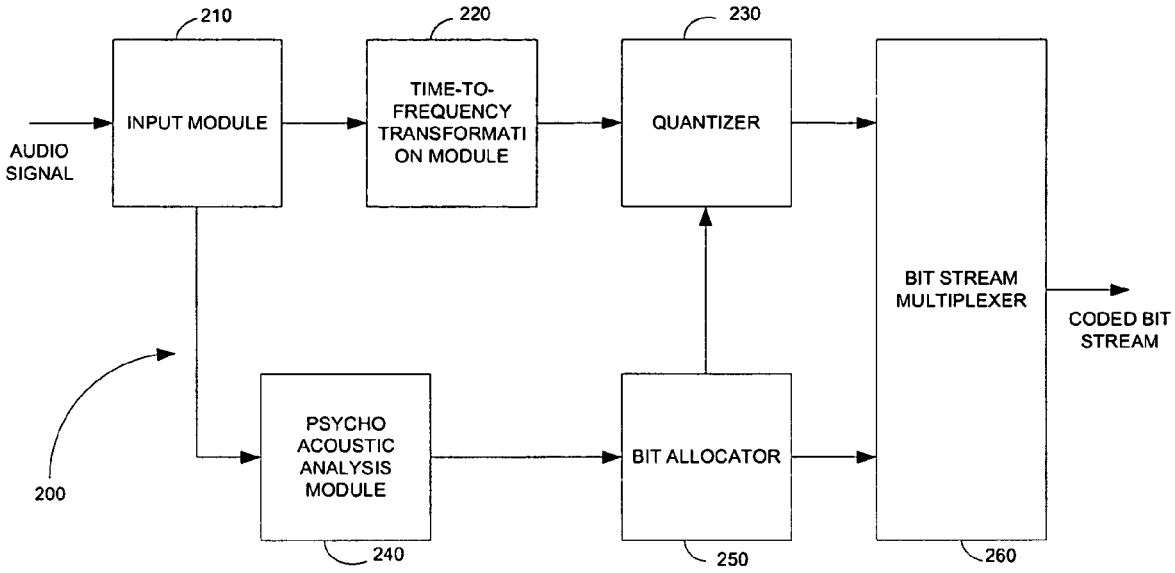
FIG. 2 is a block diagram of an encoder according to an embodiment of the present invention.

Referring now to FIG. 2, there is illustrated an example embodiment of an audio coder 200 according to an embodiment of the present invention. The audio coder 200 includes an input module 210, a time-to-frequency transformation module 220, a psychoacoustic analysis module 240, and a bit allocator 250. The audio coder 200 further includes a quantizer 230 coupled to the time-to-frequency transformation module 220 and the bit allocator 250. Further, the audio coder 200 shown in FIG. 2, includes a bit stream multiplexer 260 coupled to the quantizer 230 and the bit allocator 250.

In operation, the input module 210 receives an audio signal and partitions the received audio signal into a sequence of successive frame. The input module 210 then groups spectral lines in each frame to form a plurality of critical bands by determining their associated SMRs.

The psychoacoustic module 240 then receives the audio signal from the input module 210 and determines the effects of the psychoacoustic model. The bit allocator then performs bit allocation based on SMRs determined by psychoacoustic model and the target bit rate.

The bit allocator 250 computes a target MNR for all the critical bands in a frame using a target bit rate and associated SMRs. In some embodiments, the quantizer 230 computes the target MNR using the following equation, $$\text{target } MNR = \left(6TB - \sum_{NB} SMR_b l_b\right) \Big/ N$$

wherein TB is the Target bit rate, $SMR_b$ is the SMR of critical band b, N is the number of frequency lines in the frame, NB is the number of critical bands in the frame, and $1_b$ is the number of frequency lines in critical band b.

The bit allocator 250 then computes SNRs for all critical bands using the associated SMRs and the computed target MNR. In some embodiments, the quantizer 230 computes the SNRs using the following equation, $$SNR_b = \text{target MNR} + SMR_b$$

wherein $SNR_b$ is the signal-to-noise ratio of critical band b, MNR is the target MNR, and $SMR_b$ is the signal-to-mask ratio for the critical band b.

The bit allocator 250 then allocates bits to all the critical bands based on the associated SNRs. In some embodiments, the quantizer 230 allocates bits using the following equation when all the computed SNRs are non-negative, $$B_b = 1_b SNR_b / 6$$

wherein $B_b$ is the bits consumed by critical band indexed by b, $1_b$ is the length of the critical band b, and $SNR_b$ is the SNR of the critical band b.

In these embodiments, the bit allocator 250 forms a critical band array based on a descending order of associated SMRs when one or more of the computed SNRs are negative. The quantizer 230 then performs a binary search on the sorted critical band array to determine a critical band boundary such that the SNR of a critical band at the critical band boundary is positive and including another critical band to the right of the critical band boundary for bit allocation results in a negative SNR for the critical band at the boundary.

After completing the binary search, the bit allocator 250 computes a final target MNR. The quantizer 230 then computes revised SNRs for associated critical bands in the revised sorted critical band array using the final target MNR and the associated SMRs. The bit allocator 250 allocates bits to the critical bands in the revised sorted critical band array based on the associated revised SNRs to form a coded bit stream. The coded bit stream is then packaged by the bit stream multiplexer 260 to output a final encoded bit stream. The operation of the bit allocator 250 is explained in more detail with reference to FIG. 1.

The following table illustrates the computation efficiency achieved using the above-described techniques based on running a set of Sound Quality Assessment Material (SQAM) clips at bit rates indicated in the first column. The entries in the table below indicate the core complexity for the conventional method and the techniques described above. The following entries were arrived by taking MPEG Layer 2 encoder as an example, the total number of critical bands is 64 for a stereo pair. The sort algorithm chosen is Shell s sort [5] a $N^{3/2}$ complexity routine. Using faster algorithms, such as Heapsort and the like can further reduce the computational complexity.

| | Conventional Method | | | Present invention | | |
|---|---|---|---|---|---|---|
| Bit Rate (Kpbs) | CI | NI | Complexity Units | Sort | Partial Sum | Complexity Units |
| 192 | 64 | 180 | 11520 | 512 | 64 | 576 |
| 256 | 64 | 245 | 15680 | 512 | 64 | 576 |
| 384 | 64 | 345 | 22080 | 512 | 64 | 576 |

In the above table, CI means complexity per iteration and NI means average number of iterations.

It can be seen from the above table that the above described bit allocation strategy is nearly 20-40 times more efficient than the conventional bit allocation strategy. In the case of the MPEG Layer 2 audio coder the complexity breakup between the bit allocation part and the quantization part is approximately 4:3, at 192 Kbps. By using the above-described technique, the computational complexity of the entire quantization module can be decreased by nearly 2 to 3 times, depending on the bit rate.

Implementation in an embodiment of the present invention includes a sort routine, a routine to accumulate the partial sums of $SMR_b 1_b$ and a binary search routine that runs for $\log_2$ (NB) number of iterations. The sort routine dominates the complexity of the proposed method since the binary search routine runs for a few iterations, typically about 6 for every 50 critical bands. More significantly the computational complexity of the proposed method is independent of the target bit rate.

Various embodiments of the present invention can be implemented in software, which may be run in the environment shown in FIG. 3 (to be described below) or in any other suitable computing environment. The embodiments of the present invention are operable in a number of general-purpose or special-purpose computing environments. Some computing environments include personal computers, general-purpose computers, server computers, hand-held devices (including, but not limited to, telephones and personal digital assistants (PDAs) of all types), laptop devices, multi-processors, microprocessors, set-top boxes, programmable consumer electronics, network computers, minicomputers, mainframe computers, distributed computing environments and the like to execute code stored on a computer-readable medium. The embodiments of the present invention may be implemented in part or in whole as machine-executable instructions, such as program modules that are executed by a computer. Generally, program modules include routines, programs, objects, components, data structures, and the like to perform particular tasks or to implement particular abstract data types. In a distributed computing environment, program modules may be located in local or remote storage devices.

Figure 3:
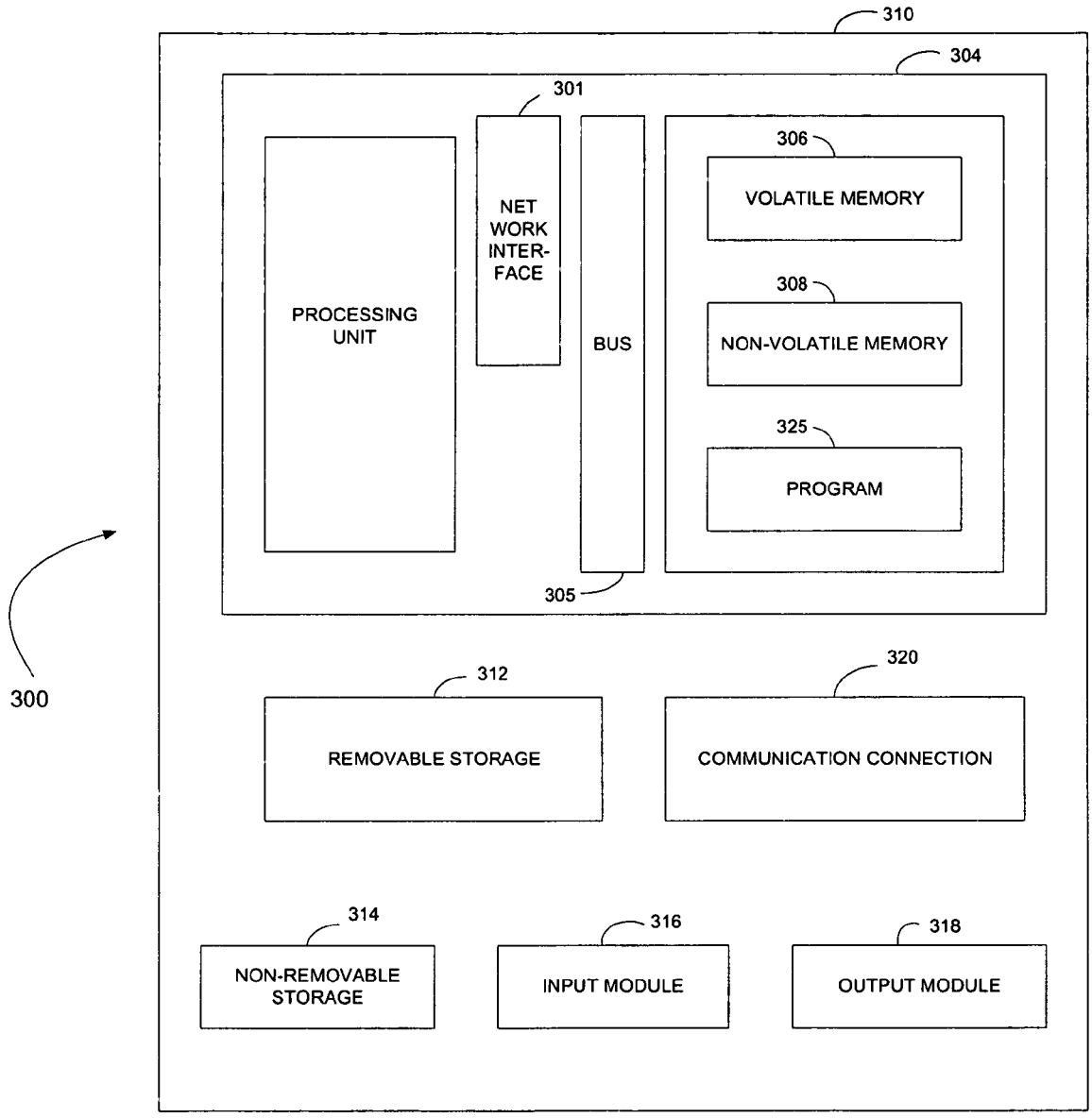
FIG. 3 is a schematic block diagram of an information-processing system that can be used to run some or all portions of the invention.

FIG. 3 shows an example of a suitable computing system environment for implementing embodiments of the present invention. FIG. 3 and the following discussion are intended to provide a brief, general description of a suitable computing environment in which certain embodiments of the inventive concepts contained herein may be implemented.

A general computing device, in the form of a computer 310, may include a processor 302, memory 304, removable storage 312, and non-removable storage 314. Computer 310 additionally includes a bus 305 and a network interface (NI) 301.

The computer 310 may include or have access to a computing environment that includes one or more user input devices 316 and one or more output devices 318. The user input device 316 can include a keyboard, a mouse, a trackball, a cursor detection keys, and/or the like. The output device 318 can include a computer display device and the like. The network interface 301 can be a USB connection. The network interface 301 can also include a Local Area Network (LAN), a Wide Area Network (WAN), and/or other networks.

The memory 304 may include volatile memory 306 and non-volatile memory 308. A variety of computer-readable media may be stored in and accessed from the memory elements of computer 310, such as volatile memory 306 and non-volatile memory 308, removable storage 312 and non-removable storage 314. Computer memory elements can include any suitable memory device(s) for storing data and machine-readable instructions, such as read only memory (ROM), random access memory (RAM), erasable programmable read only memory (EPROM), electrically erasable programmable read only memory (EEPROM), hard drive, removable media drive for handling compact disks (CDs), digital video disks (DVDs), diskettes, magnetic tape cartridges, memory cards, Memory Sticks™, and the like; chemical storage; biological storage; and other types of data storage.

"Processor" or "processing unit," as used herein, means any type of computational circuit, such as, but not limited to, a microprocessor, a microcontroller, a complex instruction set computing (CISC) microprocessor, a reduced instruction set computing (RISC) microprocessor, a very long instruction word (VLIW) microprocessor, explicitly parallel instruction computing (EPIC) microprocessor, a graphics processor, a digital signal processor, or any other type of processor or processing circuit. The term also includes embedded controllers, such as generic or programmable logic devices or arrays, application specific integrated circuits, single-chip computers, smart cards, and the like.

Embodiments of the present invention may be implemented in conjunction with program modules, including functions, procedures, data structures, application programs, etc., for performing tasks, or defining abstract data types or low-level hardware contexts.

Machine-readable instructions stored on any of the above-mentioned storage media are executable by the processor 302 of the computer 310. For example, a computer program 325 may comprise machine-readable instructions capable of encoding according to the teachings and herein described embodiments of the present invention. In one embodiment, the computer program 325 may be included on a CD-ROM and loaded from the CD-ROM to a hard drive in non-volatile memory 308. The machine-readable instructions cause the computer 310 to encode according to the embodiments of the present invention.

The encoding technique of the present invention is modular and flexible in terms of usage in the form of a "Distributed Configurable Architecture". As a result, parts of the quantizer may be placed at different points of a network, depending on the model chosen. For example, the technique can be deployed in a server and the input and output modules streamed over from a client to the server and back, respectively.

The proposed scheme overcomes the drawback of the conventional method by presuming that all critical bands at the end of the bit allocation process have to be equally distorted and the quantizer used is uniform in nature.

The above description is intended to be illustrative, and not restrictive. Many other embodiments will be apparent to those skilled in the art. The scope of the invention should therefore be determined by the appended claims, along with the full scope of equivalents to which such claims are entitled.

It is to be understood that the above-description is intended to be illustrative, and not restrictive. Many other embodiments will be apparent to those of skill in the art upon reviewing the above-description. The scope of the subject matter should, therefore, be determined with reference to the following claims, along with the full scope of equivalents to which such claims are entitled.

As shown herein, the present invention can be implemented in a number of different embodiments, including various methods, a circuit, an I/O device, a system, and an article comprising a machine-accessible medium having associated instructions.

Other embodiments will be readily apparent to those of ordinary skill in the art. The elements, algorithms, and sequence of operations can all be varied to suit particular requirements. The operations described-above with respect to the method illustrated in FIG. 1 can be performed in a different order from those shown and described herein.

FIGS. 1, 2 and 3 are merely representational and are not drawn to scale. Certain portions thereof may be exaggerated, while others may be minimized. FIGS. 1-3 illustrate various embodiments of the invention that can be understood and appropriately carried out by those of ordinary skill in the art.

It is emphasized that the Abstract is provided to comply with 37 C.F.R. §1.72(b) requiring an Abstract that will allow the reader to quickly ascertain the nature and gist of the technical disclosure. It is submitted with the understanding that it will not be used to interpret or limit the scope or meaning of the claims.

In the foregoing detailed description of embodiments of the invention, various features are grouped together in a single embodiment for the purpose of streamlining the disclosure. This method of disclosure is not to be interpreted as reflecting an intention that the claimed embodiments of the invention require more features than are expressly recited in each claim. Rather, as the following claims reflect, inventive subject matter lies in less than all features of a single disclosed embodiment. Thus the following claims are hereby incorporated into the detailed description of embodiments of the invention, with each claim standing on its own as a separate embodiment.

It is understood that the above description is intended to be illustrative, and not restrictive. It is intended to cover all alternatives, modifications and equivalents as may be included within the spirit and scope of the invention as defined in the appended claims. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein," respectively.

What is claimed is:

1. A method of allocating bits in perceptual audio encoders comprising:

computing a target Mask-to-Noise Ratio (MNR) for all critical bands in a frame using a target bit rate and associated SMRs by an encoder, wherein the target MNR is computed using the equation:

$$\text{target } MNR=(6\ TB-\Sigma_{NB}SMR_b 1_b)/N,$$

wherein TB is the Target bit rate, $SMR_b$ is the signal-to-mask ratio of a critical band b, N is the number of frequency lines in the frame, NB is the number of the critical bands in the frame, and $1_b$ is the number of frequency lines in the critical band b;

computing associated SNRs for the critical bands in the frame using the target MNR and the associated SMRs by the encoder, wherein the SNRs for the critical bands in the frame are computed using the equation:

$$SNR_b=\text{target } MNR+SMR_b,$$

wherein $SNR_b$ is the signal-to-noise ratio of the critical band b, and MNR is the target MNR; and allocating bits to the critical bands based on the associated SNRs by the encoder, wherein allocating the bits to the critical bands based on the associated SNRs comprises:

determining whether any of the SNRs associated with the critical bands are negative;

if not, allocating the bits to the critical bands based on the associated SNRs;

if so, sorting the critical bands in the frame in a descending order of associated SMRs to form a sorted critical band array;

performing a binary search on the sorted critical band array to determine a critical band boundary such that the SNR of a critical band at the critical band boundary is positive and when a critical band to the right of the determined critical band boundary is included in the bit allocation the SNR of the critical band at the critical band boundary becomes negative and computing a final target MNR;

removing the critical bands that fall to the right of the determined critical band boundary from the sorted critical band array to form a revised sorted critical band array;

computing revised SNRs for associated critical bands in the revised sorted critical band array using the final target MNR and the associated SMRs; and allocating bits to the critical bands in the revised sorted critical band array based on the associated revised SNRs.

2. The method of claim 1, further comprising:

partitioning the signal into a sequence of successive frames; and grouping spectral lines in each frame to form a plurality of critical bands, wherein each critical band is associated with an SMR provided by a psychoacoustic model.

3. The method of claim 1, wherein, in allocating the bits to the critical bands, the bits in the critical bands are computed using the equation, $$B_b=1_b SNR_b/6$$

wherein $B_b$ is the bits consumed by critical band indexed by b, $1_b$ is the length of the critical band b, and $SNR_b$ is the SNR of the critical band b.

4. An article comprising a computer readable storage medium having instructions that, when executed by a computer, causes the computer to perform a method of allocating bits in perceptual audio encoders, comprising:

computing a target Mask-to-Noise Ratio (MNR) for all critical bands in a frame using a target bit rate and associated SMRs, wherein the target MNR is computed using the equation:

$$\text{target } MNR=(6\ TB-\Sigma_{NB}SMR_b 1_b)/N,$$

wherein TB is the Target bit rate, $SMR_b$ is the signal-to-mask ratio of a critical band b, N is the number of frequency lines in the frame, NB is the number of the critical bands in the frame, and $1_b$ is the number of frequency lines in the critical band b;

computing associated SNRs for the critical bands in the frame using the target MNR and the associated SMRs, wherein the SNRs for the critical bands in the frame are computed using the equation:

$$SNR_b=\text{target } MNR+SMR_b,$$

wherein $SNR_b$ is the signal-to-noise ratio of the critical band b, and MNR is the target MNR; and allocating bits to the critical bands based on the associated SNRs, wherein allocating the bits to the critical bands based on the associated SNRs comprises:

determining whether any of the SNRs associated with the critical bands are negative;

if not, allocating the bits to the critical bands based on the associated SNRs;

if so, sorting the critical bands in the frame in a descending order of associated SMRs to form a sorted critical band array;

performing a binary search on the sorted critical band array to determine a critical band boundary such that the SNR of a critical band at the critical band boundary is positive and when a critical band to the right of the determined critical band boundary is included in the bit allocation the SNR of the critical band at the critical band boundary becomes negative and computing a final target MNR;

removing the critical bands that fall to the right of the determined critical band boundary from the sorted critical band array to form a revised sorted critical band array;

computing revised SNRs for associated critical bands in the revised sorted critical band array using the final target MNR and the associated SMRs; and allocating bits to the critical bands in the revised sorted critical band array based on the associated revised SNRs.

5. The article of claim 4, further comprising;

partitioning the signal into a sequence of successive frames; and grouping spectral lines in each frame to form a plurality of critical bands, wherein each critical band is associated with an SMR provided by a psychoacoustic model.

6. An apparatus comprising:

an encoder that computes a target Mask-to-Noise Ratio (MNR) for all critical bands in a frame using a target bit rate and associated SMRs, wherein the encoder computes the target MNR using the equation:

$$\text{target } MNR=(6\ TB-\Sigma_{NB}SMR_b 1_b)/N,$$

wherein TB is the Target bit rate, $SMR_b$ is the signal-to-mask ratio of a critical band b, N is the number of frequency lines in the frame, NB is the number of the critical bands in the frame, and $1_b$ is the number of frequency lines in the critical band b, wherein the encoder computes SNRs for all critical bands using the target MNR, and wherein the encoder computes SNRs for the critical bands in the frame using the equation:

$$SNR_b = \text{target } MNR + SMR_b,$$

wherein $SNR_b$ is the signal-to-noise ratio of the critical band b, MNR is the target MNR; and a bit allocator that allocates bits to all the critical bands based on the associated SNRs, wherein the bit allocator allocates bits to the critical bands based on the associated SNRs if all the SNRs are not negative, wherein the encoder forms a sorted critical band array based on descending order of associated SMRs if one or more of the computed SNRs are negative, wherein the encoder performs a binary search on the sorted critical band array to determine a critical band boundary such that a SNR at the critical band boundary is positive and when a critical band to the right of the determined critical band boundary is included in the bit allocation, wherein the encoder removes the critical bands that fall to the right of the determined critical band boundary from the sorted critical band array to form a revised sorted critical band array and computes a final target MNR, wherein the encoder computes revised SNRs for the critical bands in the revised sorted critical band array using the final target MNR and the associated SMRs, and wherein the bit allocator allocates bits to the critical bands in the revised sorted critical band array based on the associated revised SNRs.

7. The apparatus of claim 6, further comprising:

an input module that partitions an audio signal into a sequence of successive frames; and a time-to-frequency transformation module that performs frequency analysis on each frame and groups spectral lines in each frame to form associated critical bands; and a psychoacoustic analysis module that computes SMRs for associated critical bands.

8. The apparatus of claim 6, wherein the bit allocator allocates bits to the critical bands using the equation, $$B_b = 1_b SNR_b / 6$$

wherein Bb is the bits consumed by critical band indexed by b, $1_b$ is the length of the critical band b, and $SNR_b$ is the SNR of the critical band b.

9. A system comprising:

a bus;

a processor coupled to the bus;

a memory coupled to the processor;

a network interface coupled to the processor and the memory; and an audio coder coupled to the network interface and the processor, wherein the audio coder further comprises:

an encoder that computes a target Mask-to-Noise Ratio (MNR) for all critical bands in a frame using a target bit rate and associated SMRs, wherein the encoder computes the target MNR using the equation:

$$\text{target } MNR_{value} = (6\ TB - \Sigma_{NB} SMR_b 1_b)/N,$$

wherein TB is the Target bit rate, $SMR_b$ is the signal-to-mask ratio of a critical band b, N is the number of frequency lines in the frame, NB is the number of the critical bands in the frame, and 1b is the number of frequency lines in critical band b, wherein the encoder computes SNRs for all critical bands using the target MNR and associated SMRs, wherein the encoder computes SNRs for the critical bands in the frame using the equation:

$$SNR_b = \text{target } MNR + SMR_b,$$

wherein $SNR_b$ is the signal-to-noise ratio of the critical band b, MNR is the target MNR; and a bit allocator that allocates bits to all critical bands based on the associated SNRs, wherein the bit allocator allocates bits to the critical bands based on the associated SNRs if all the SNRs are not negative, wherein the encoder forms a sorted critical band array based on descending order of associated SMRs if one or more of the computed SNRs are negative, wherein the encoder performs a binary search on the sorted critical band array to determine a critical band boundary such that a SNR at the critical band boundary is positive and when a critical band to the right of the determined critical band boundary is included in the bit allocation, wherein the encoder removes the critical bands that fall to the right of the determined critical band boundary from the sorted critical band array to form a revised sorted critical band array and computes a final target MNR, wherein the encoder computes revised SNRs for the critical bands in the revised sorted critical band array using the final target MNR and the associated SMRs, and wherein the bit allocator allocates bits to the critical bands in the revised sorted critical band array based on the associated revised SNRs.

10. The system of claim 9, wherein the audio coder further comprising:

an input module that partitions an audio signal into a sequence of successive frames; and a time-to-frequency transformation module that groups the spectral lines in each frame and forms critical bands by determining associated SMRs.

* * * * *